US011801683B2

(12) United States Patent
Moriyama

(10) Patent No.: US 11,801,683 B2
(45) Date of Patent: Oct. 31, 2023

(54) LIQUID EJECTING HEAD AND LIQUID EJECTING APPARATUS

(71) Applicant: SEIKO EPSON CORPORATION, Tokyo (JP)

(72) Inventor: Keita Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 142 days.

(21) Appl. No.: 17/448,372

(22) Filed: Sep. 22, 2021

(65) Prior Publication Data

US 2022/0097402 A1 Mar. 31, 2022

(30) Foreign Application Priority Data

Sep. 25, 2020 (JP) ..... 2020-161008

(51) Int. Cl.
*B41J 2/175* (2006.01)
*B41J 2/14* (2006.01)
*B41J 2/155* (2006.01)

(52) U.S. Cl.
CPC ..... *B41J 2/17563* (2013.01); *B41J 2/14016* (2013.01); *B41J 2/155* (2013.01); *B41J 2002/14403* (2013.01)

(58) Field of Classification Search
CPC .... B41J 2/17563; B41J 2/135; B41J 2/14016; B41J 2/155; B41J 2002/14403
See application file for complete search history.

(56) References Cited

U.S. PATENT DOCUMENTS

2012/0062659 A1 3/2012 Tsubaki
2015/0258786 A1 9/2015 Akahane et al.
2016/0059576 A1* 3/2016 Ito ..... B41J 2/19 347/93
2017/0274651 A1* 9/2017 Takino ..... B41J 2/17563
2018/0297369 A1 10/2018 Emi
2019/0016148 A1* 1/2019 Akahane ..... B41J 2/17563

FOREIGN PATENT DOCUMENTS

JP 2012-056248 A 3/2012
JP 2015-174391 A 10/2015
JP 2018-176715 A 11/2018

* cited by examiner

*Primary Examiner* — Thinh H Nguyen
(74) *Attorney, Agent, or Firm* — WORKMAN NYDEGGER

(57) ABSTRACT

A liquid ejecting head includes a nozzle configured to eject ink, a filter chamber accommodating a filter, and a nozzle introduction port through which the ink flows out of the filter chamber. The filter chamber includes a first side and a second side that extend toward the nozzle introduction port in plan view in a direction perpendicular to the filter, and the nozzle introduction port is elongated along the first side in plan view in the direction perpendicular to the filter.

13 Claims, 10 Drawing Sheets

LIQUID EJECTING HEAD AND LIQUID EJECTING APPARATUS

The present application is based on, and claims priority from JP Application Serial Number 2020-161008, filed Sep. 25, 2020, the disclosure of which is hereby incorporated by reference herein in its entirety.

BACKGROUND

1. Technical Field

The present disclosure relates to a liquid ejecting head and a liquid ejecting apparatus and particularly relates to an ink jet recording head that ejects ink, which is an example of a liquid, and an ink jet recording apparatus.

2. Related Art

Typical examples of a liquid ejecting head include an ink jet recording head that ejects ink, which is an example of a liquid. In the ink jet recording head, a filter chamber is provided halfway along a channel, and a foreign substance, such as air bubbles, contained in the ink is captured by a filter provided in the filter chamber. Various liquid ejecting heads that enable air bubbles captured by the filter to be readily discharged from the filter chamber have been proposed (for example, refer to JP-A-2018-176715).

In the liquid ejecting head described in JP-A-2018-176715, to improve air discharging performance, an outlet for supplying liquid to a nozzle is arranged upward in the direction opposite to the direction of gravity in a downstream chamber included in the filter chamber, and the downstream chamber has a pair of linear sections inclined toward the outlet such that the width of the downstream chamber gradually decreases upward in the direction opposite to the direction of gravity. The outlet has a perfectly circular shape. Note that a nozzle surface is parallel to the horizontal plane, and the filter is arranged perpendicularly to the horizontal plane.

An ink jet recording head that enables ink to circulate between the recording head and an ink supply unit has been proposed. In the ink jet recording head, ink is circulated, for example, to discharge air bubbles contained in the ink, to suppress an increase in viscosity of the ink, and to suppress sedimentation of components contained in liquid (for example, refer to JP-A-2012-056248).

In the liquid ejecting head described in JP-A-2012-056248, an outlet for circulation is provided both upstream and downstream of a filter chamber, and an outlet for supplying ink to a nozzle is provided in a downstream chamber. A nozzle surface is not inclined, whereas a filter is inclined.

According to the liquid ejecting head described in JP-A-2018-176715, since the pair of linear sections is linearly symmetrical (the sections are inclined at the same angle) in plan view of the downstream chamber, air bubbles generated in the downstream chamber are discharged uniformly to the outlet along the pair of right and left linear sections. However, when the pair of linear sections directed toward the outlet is not linearly symmetrical, that is, when the linear sections of the pair are each inclined at a different angle, air bubbles flowing along the linear section whose inclination angle is less than the other move more slowly than air bubbles flowing along the linear section whose inclination angle is greater than the other, resulting in a possible deterioration in air discharging performance.

Such a deterioration in air discharging performance similarly occurs when the liquid ejecting head described in JP-A-2012-056248 discharges air bubbles from the respective circulation outlets provided upstream and downstream of the filter chamber.

Note that such a problem exists not only in ink jet recording apparatuses but also in liquid ejecting apparatuses that eject liquid other than ink.

SUMMARY

A liquid ejecting head according to an aspect of the disclosure includes a nozzle that ejects a liquid, a filter chamber that accommodates a filter, and an outlet through which the liquid flows out of the filter chamber, in which the filter chamber includes a first side and a second side that extend toward the outlet in plan view in a direction perpendicular to the filter, and the outlet is elongated along either the first side or the second side in plan view in the direction perpendicular to the filter.

A liquid ejecting apparatus according to an aspect of the disclosure includes the liquid ejecting head and a holding section that holds the liquid ejecting head such that the filter is inclined relative to a horizontal plane.

DESCRIPTION OF EXEMPLARY EMBODIMENTS

Embodiment 1

Figure 1:
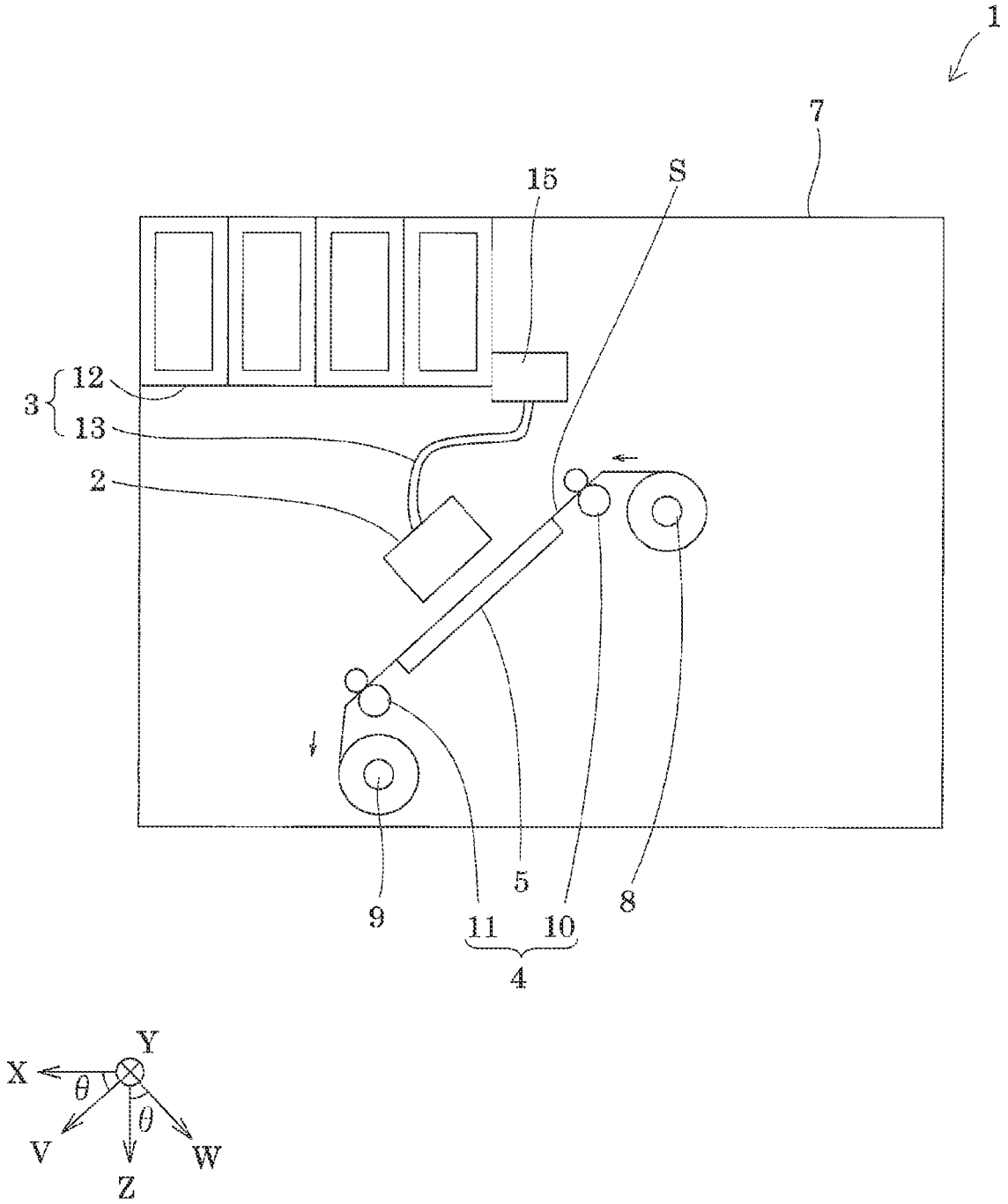
FIG. 1 illustrates a schematic configuration of an ink jet recording apparatus according to Embodiment 1.

The disclosure will be described below in detail with reference to embodiments. Note that the following describe an aspect of the disclosure and can be modified appropriately within the scope of the disclosure. Members with the same reference numerals in the drawings denote the same members, and description thereof will be appropriately omitted.

The X-axis, the Y-axis, and the Z-axis in the drawings denote three spatial axes orthogonal to each other. In the present specification, directions extending along the X-axis, the Y-axis, and the Z-axis are the X direction, the Y direction, and the Z direction, respectively. The V-axis is obtained by rotating the X-axis by an angle θ about the Y-axis, the W-axis is obtained by rotating the Z-axis by an angle θ, and directions extending along the V-axis and the W-axis are the V direction and the W direction, respectively. Description will be given by assuming that a direction of an arrow in each drawing is a positive (+) direction and a direction opposite to the direction of the arrow is a negative (−) direction. The Z direction is the vertical direction, the +Z direction is the vertically down direction, and the −Z direction is the vertically up direction.

FIG. 1 illustrates a schematic configuration of an ink jet recording apparatus 1, which is an example of a liquid ejecting apparatus, according to Embodiment 1 of the disclosure.

As illustrated in FIG. 1, the ink jet recording apparatus 1 is a printing apparatus that ejects ink, which is a kind of liquid, as ink droplets, causes the ink to be deposited on a medium S such as a printing sheet, and performs printing of an image or the like by forming an array of dots on the medium S.

The ink jet recording apparatus 1 includes a line head 2 including an ink jet recording head 100 (hereinafter, simply referred to as a recording head 100) for ejecting ink, a liquid supply section 3, a transport section 4 that transports the medium S in a transport direction, a support table 5, and a holding section 6. The line head 2, a liquid container 12, the transport section 4, the support table 5, and the holding section 6 are accommodated in a housing 7.

The line head 2 includes plural recording heads 100 held by the holding section 6 and is arranged in the housing 7. The holding section 6 holds the line head 2 such that a filter, which will be described later, of the recording head 100 is inclined relative to the XY plane, which is the horizontal plane.

Each of the recording heads 100 of the line head 2 is held such that a direction in which ink droplets are ejected is the +W direction obtained when the +Z direction, which is a vertical direction (also referred to as the direction of gravity), is rotated about the Y-axis and inclined. In other words, the direction in which ink droplets are ejected from nozzles is the +W direction, which is inclined in the −X direction relative to the +Z direction. Note that an angle θ at which the recording head 100 included in the line head 2 is inclined relative to the +Z direction, that is, an angle θ at which the W direction, which is the direction in which ink droplets are ejected, is inclined relative to the +Z direction, is set within a range of, for example, $0<\theta\leq 180°$. When θ exceeds 90°, the direction in which ink droplets are ejected includes a −Z-direction component.

Note that the recording heads 100 of the line head 2 are held by the holding section 6 in a state of being inclined relative to the horizontal plane in the present embodiment but is not necessarily required to be held persistently in such a state. For example, the configuration may be such that an adjusting mechanism for adjusting inclination of the line head 2 relative to the horizontal plane is provided to hold the recording heads 100 in the inclined state only during a maintenance operation such as suction cleaning described later or during printing, in which ink is ejected onto the medium S.

The medium S of the present embodiment is, for example, one of the media including recording paper such as continuous paper, fabric, a resin film, and the like, and the medium S is held in a state of being wound in a roll shape around a delivery shaft 8. The medium S is transported by the transport section 4 onto the support table 5, such as a platen, which is disposed to be spaced apart from a nozzle surface on which the nozzles of the recording heads 100 are formed, and printing is performed on the support table 5 by the line head 2. The configuration is such that the medium S on the support table 5 is subjected to printing by the recording heads 100 and is wound around a winding shaft 9 by the transport section 4.

A mounting surface of the support table 5 on which the medium S is mounted is arranged to be inclined by the same degrees as the inclination angle of the nozzle surface of the recording heads 100. That is, the inclination angle θ of the nozzle surface and the support table 5 is set such that a distance between each nozzle on the nozzle surface and the medium S remains constant during a printing operation. In other words, the mounting surface of the support table 5 is parallel to the VY plane defined by the V-axis and the Y-axis, and an angle between the mounting surface and the XY plane is the inclination angle θ. The V direction is a direction orthogonal to the W direction and a direction orthogonal to the Y direction. On the mounting surface of the support table 5, the medium S is transported by the transport section 4 in the +V direction or the −V direction. Hereinafter, the +V direction and the −V direction are also referred to as a transport direction.

The longitudinal direction of the line head 2 including the recording heads 100 is the Y direction orthogonal to the transport direction of the medium S, and the line head 2 includes plural nozzles that are arranged such that a printing range in the Y direction is equal to or more than a printing range of the medium S in the Y direction. That is, the line head 2 of the present embodiment is fixed so as not to move in the Y-axis direction with respect to the housing 7 during a printing operation.

Note that the medium S is not limited to continuous paper or the like, and various ejection target media on which ink droplets ejected from the nozzles of the recording heads 100 are able to be deposited may be adopted. For example, the disclosure is applicable to an instance in which ink droplets are ejected onto a three-dimensional ejection target. Moreover, the support table 5 is not limited to a platen having a planar mounting surface on which the medium S is mounted, and may be a drum platen, such as a drum, which has a curved mounting surface on which the medium S is mounted. A rear-surface side of the medium S may be supported by a transport belt such as an endless belt.

The transport section 4 includes a feed roller 10 and a transport roller 11. The feed roller 10 includes a pair of upper and lower rollers capable of rotating simultaneously in opposite directions with the medium S held therebetween. The feed roller 10 is driven by a motor (not illustrated) and supplies the medium S from around the delivery shaft 8 toward the support table 5. The transport roller 11 is arranged opposite from the feed roller 10 with the support table 5 interposed therebetween and guides the printed medium S toward the winding shaft 9. Note that the medium S is not necessarily wound around the winding shaft 9. Although the present embodiment exemplifies the transport section 4 that includes the feed roller 10 and the transport roller 11, the transport section 4 is not particularly limited thereto and may transport the medium S by using a belt or a drum.

The liquid supply section 3 includes the liquid container 12 for accumulating ink and a liquid supply channel 13 for supplying the ink from the liquid container 12 to the recording head 100.

The liquid container 12 stores ink to be ejected from the recording head 100. Each liquid container 12 stores a respective type of ink of a different color. In the present embodiment, four liquid containers 12 are provided in the housing 7. Examples of the liquid container 12 include a detachable cartridge, a bag-like ink pack formed from a flexible film, and an ink tank that is able to be replenished with ink. Note that the number of liquid containers 12 is not particularly limited and may be one or two or more.

The supply channel 13 is a channel through which the ink is supplied from the liquid container 12 to the recording head 100, and a pressure-feeding unit 15 for pressure-feeding the ink from the liquid container 12 to the recording head 100 is provided halfway in the supply channel 13. Examples of the pressure-feeding unit 15 include a pressing unit for pressing the liquid container 12 from outside and a pressure pump. In the present embodiment, a pressure pump is provided as the pressure-feeding unit 15. Note that, for example, the pressure-feeding unit 15 may use a hydraulic head pressure difference generated by adjusting relative positions of the recording head 100 and the liquid container 12 in the vertical direction.

Figure 2:
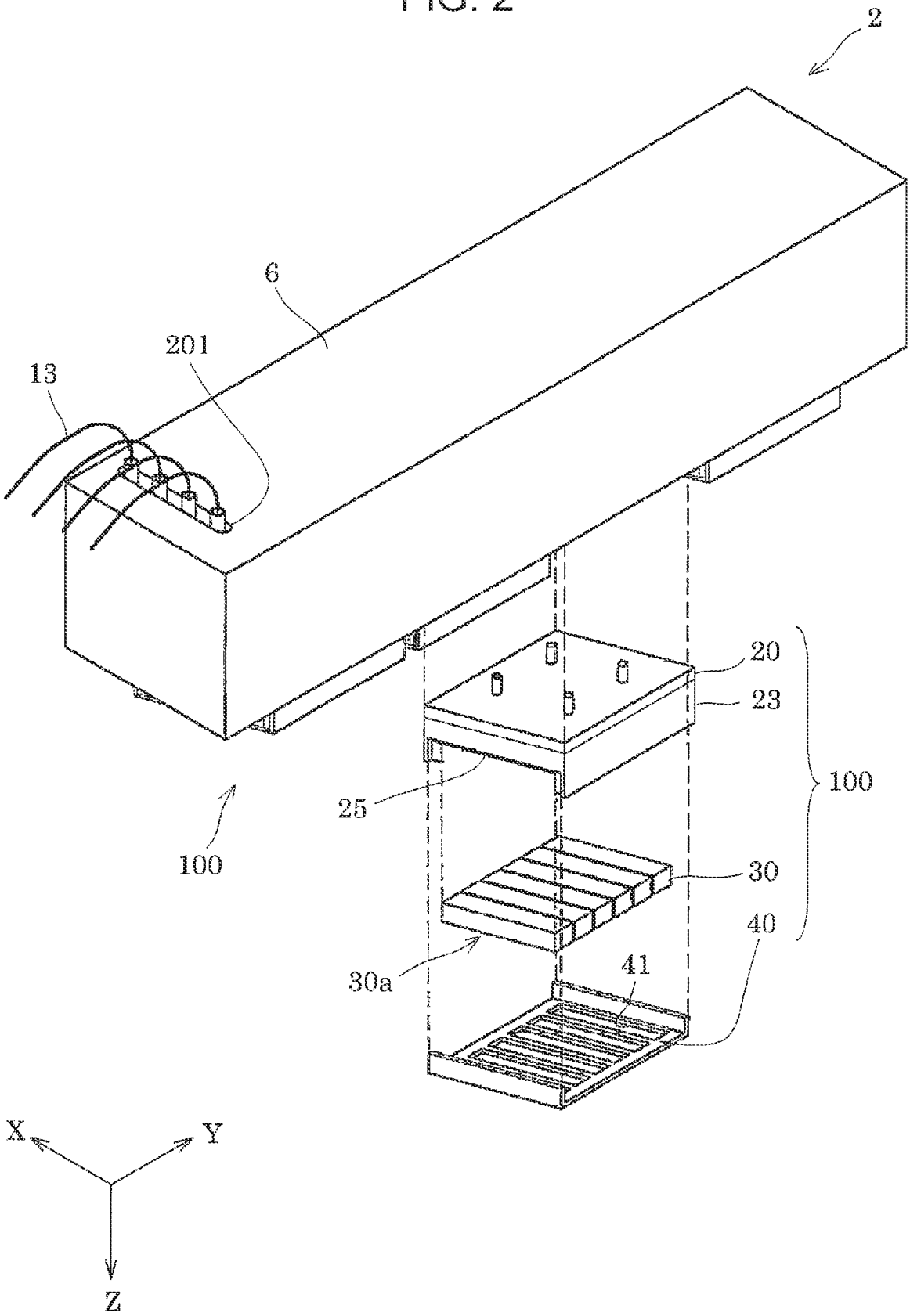
FIG. 2 is an exploded perspective view illustrating a recording head according to Embodiment 1.
Figure 3:
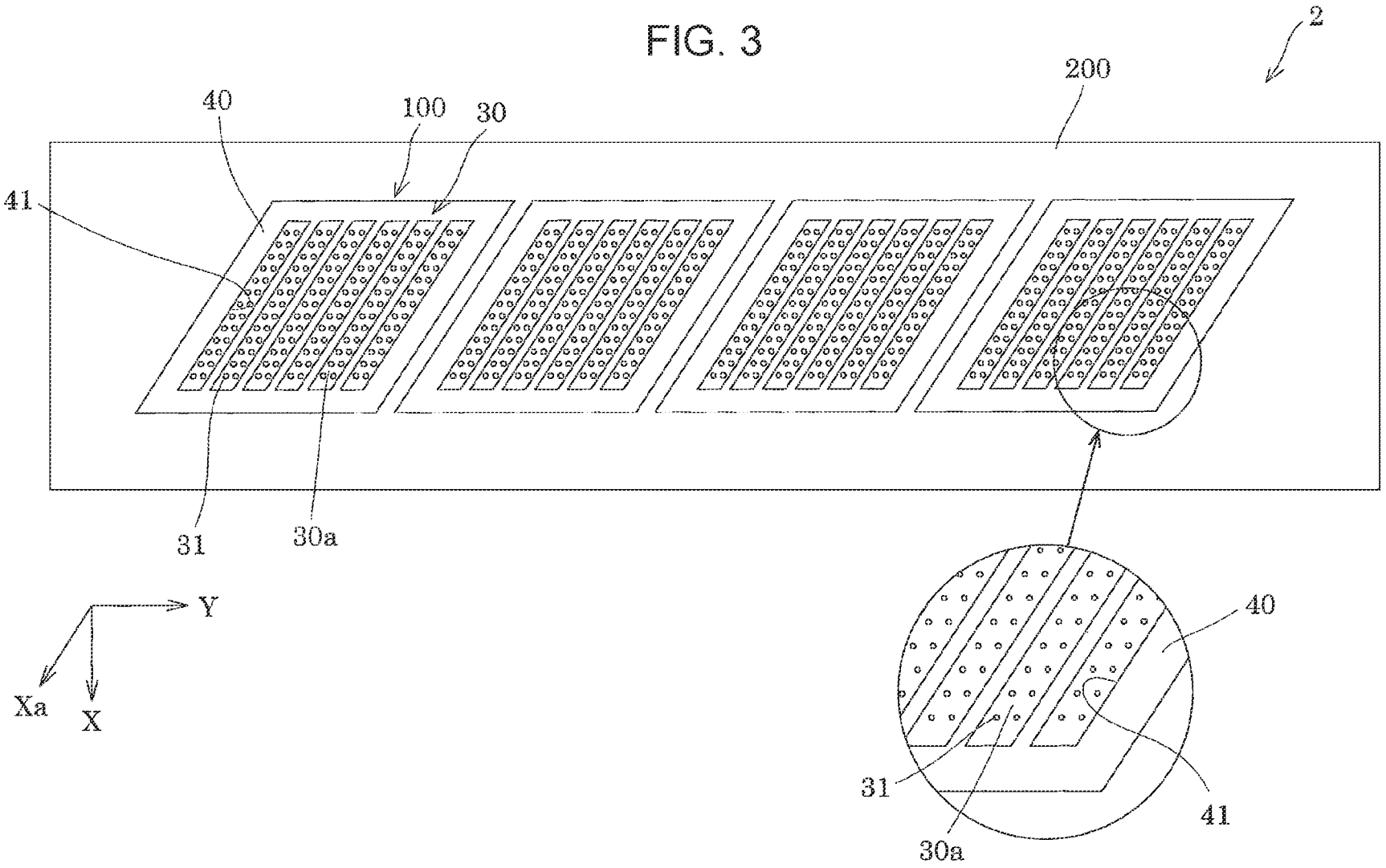
FIG. 3 is a plan view of a nozzle surface side of the recording head according to Embodiment 1.

Here, the recording head 100 of the present embodiment will be further described in detail with reference to FIGS. 2 and 3. FIG. 2 is an exploded perspective view illustrating the recording head according to Embodiment 1 of the disclosure, and FIG. 3 is a plan view of the nozzle surface side of the recording head. FIGS. 2 and 3 illustrate the recording head arranged such that the ink ejection direction is the +Z direction.

The line head 2 includes the plural recording heads 100 and the holding section 6 that holds the plural recording heads 100.

The recording head 100 is fixed to the +Z-direction side of the holding section 6, that is, the surface side facing the medium S. The plural recording heads 100 are provided side by side in the holding section 6 in the Y direction orthogonal to the X direction. Note that, although four recording heads 100 are fixed to the holding section 6 in the present embodiment, two or more recording heads 100 may be provided, or the line head 2 may include a single recording head 100.

The holding section 6 is provided with a coupling section 201, to which the supply channel 13 is attached, on the −Z-direction side surface thereof. In the present embodiment, four coupling sections 201 are provided, and each of the four coupling sections 201 is coupled to a corresponding one of the supply channels 13.

A channel (not illustrated) communicating with the coupling section 201 is provided in the holding section 6. The channel in the holding section 6 is formed to distribute the ink to the plural recording heads 100, in the present embodiment, the four recording heads 100.

The recording head 100 of the present embodiment includes plural head chips 30, a holder 23 having a channel for the ink supplied to the plural head chips 30, a filter member 20 having a channel for the ink supplied to the holder 23, and a cover 40 provided on a nozzle surface 30*a* side of a head chip 30.

The nozzle surface 30*a* having nozzles 31 is provided on the +Z-direction side of the head chip 30. The −Z-direction side surfaces of the plural head chips 30 are attached to the +Z-direction side surface of the holder 23. A distribution channel for distributing and supplying, to the plural head chips 30, the ink supplied from the filter member 20 is provided in the holder 23. In an interior (not illustrated) of the head chip 30, a channel communicating with the nozzles 31, a pressure generating unit for causing a pressure change in the ink in the channel, and the like are provided. Examples of the pressure generating unit include, for example, a unit that changes the capacity of a liquid channel upon deformation of a piezoelectric actuator including a piezoelectric material having an electromechanical conversion function, which causes a pressure change in the ink in the liquid channel and thereby causes ink droplets to be ejected from the nozzles 31, a unit in which a heat generating element is arranged in the channel in which ink droplets are ejected from the nozzles 31 by bubbles generated when the heat generating element generates heat, and an electrostatic actuator which generates an electrostatic force between a diaphragm and an electrode and deforms the diaphragm by using the electrostatic force to eject ink droplets from the nozzles 31.

The filter member 20 includes a filter chamber 50 serving as a portion of a channel for the ink supplied to the head chip 30 via the holder 23 and a filter 57 arranged in the filter chamber 50. The configuration of the filter member 20 will be described later in detail.

The holder 23 has a fixing section 25 that forms a groove-like space on the +Z-direction side thereof. The fixing section 25 is provided continuously in the Y direction across the surface on the +Z-direction side of the holder 23 such that both side surfaces of the holder 23 in the Y direction are opened. The plural head chips 30 are arranged side by side in the Y direction in the fixing section 25 of the holder 23 and are fixed via adhesive or the like. In the present embodiment, six head chips 30 are attached to a single holder 23. Needless to say, the number of head chips 30 fixed to a single filter member 20 is not limited thereto and may be one or two or more.

The plural head chips 30 of the present embodiment are fixed such that nozzle rows in the in-plane direction of the nozzle surface 30*a* are inclined relative to the X direction. That is, the Xa direction in which the nozzles 31 included in the nozzle rows are provided side by side is inclined relative to the X direction. That is, the plural nozzles 31 are arranged in the Xa direction on the plane defined by the Xa direction and the Y direction, which intersects the Xa direction.

The cover 40 is formed by bending a plate member made of metal or the like and includes an opening 41 serving as a through hole for exposing the nozzles 31 of each of the head chips 30. In the present embodiment, the opening 41 is provided so as to be opened independently for each of the head chips 30. That is, since the recording head 100 of the present embodiment has six head chips 30, six independent openings 41 are provided in the cover 40.

The cover 40 is joined to the holder 23 via adhesive. In the state in which the cover 40 is joined to the holder 23, the nozzle surface 30*a* and the nozzles 31 of each of the head chips 30 are exposed from the opening 41 in plan view from the nozzle surface 30*a* side.

Note that the recording head 100 of the present embodiment has a substantially parallelogram shape in plan view from the nozzle surface 30*a* side, but the shape is not limited to a substantially parallelogram shape and may be a rectangular shape, a trapezoidal shape, a polygonal shape, or the like.

Figure 4:
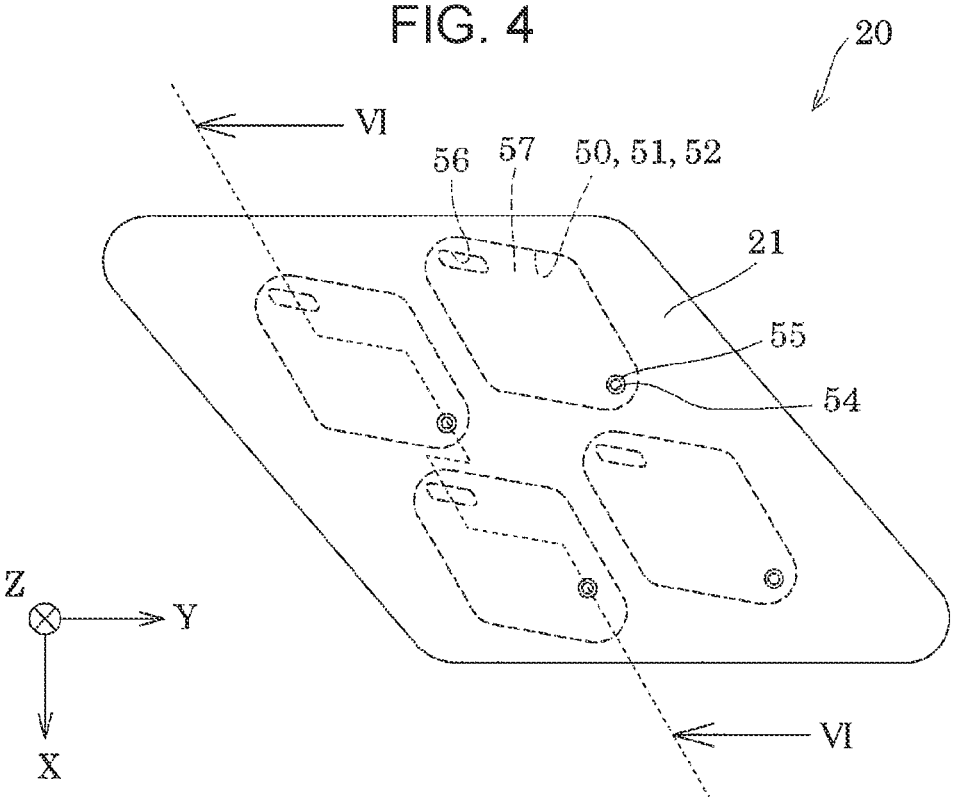
FIG. 4 is a plan view of a filter member viewed in a direction perpendicular to a filter.
Figure 6:
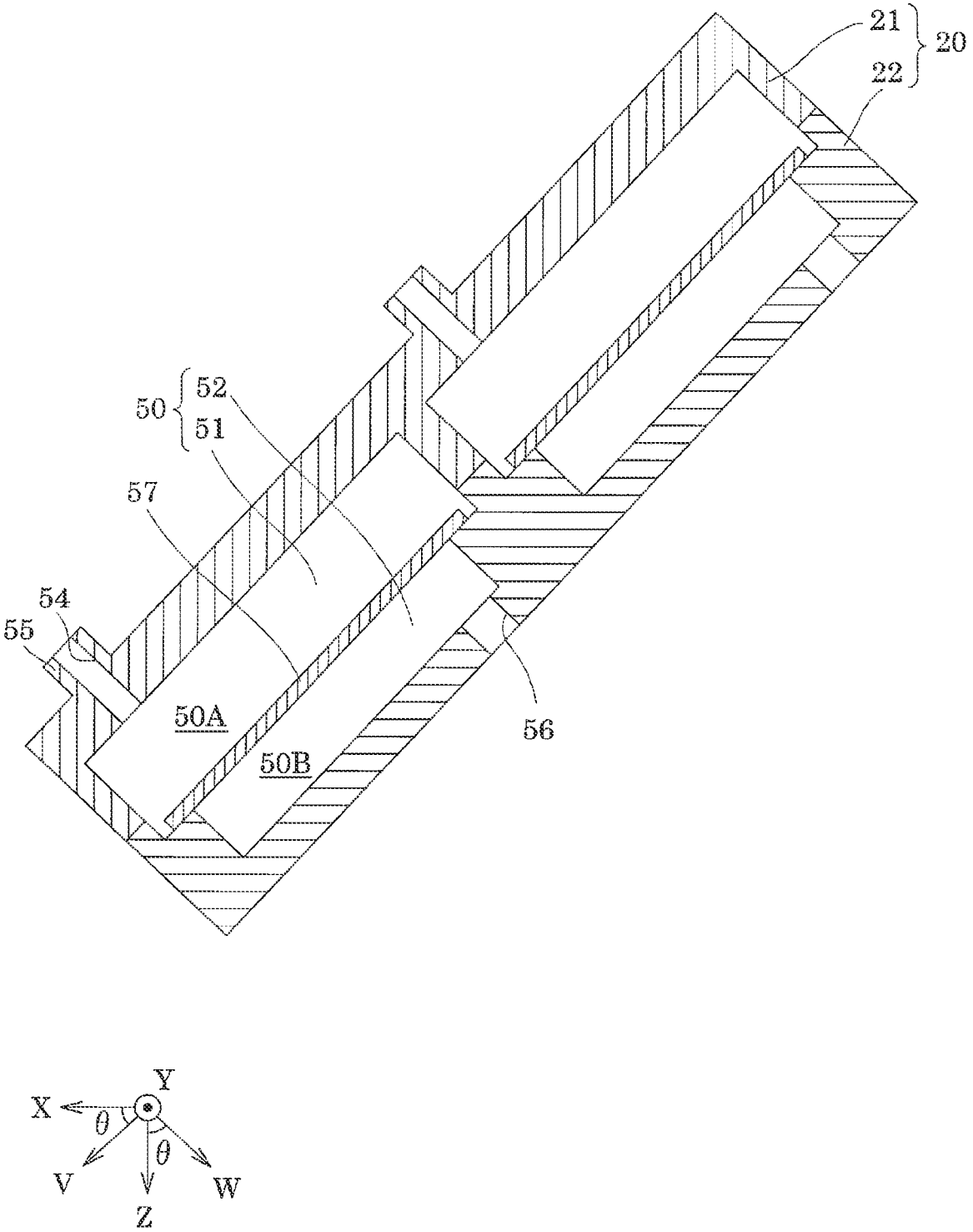
FIG. 6 is a sectional view along line VI-VI in FIG. 4.
Figure 7:
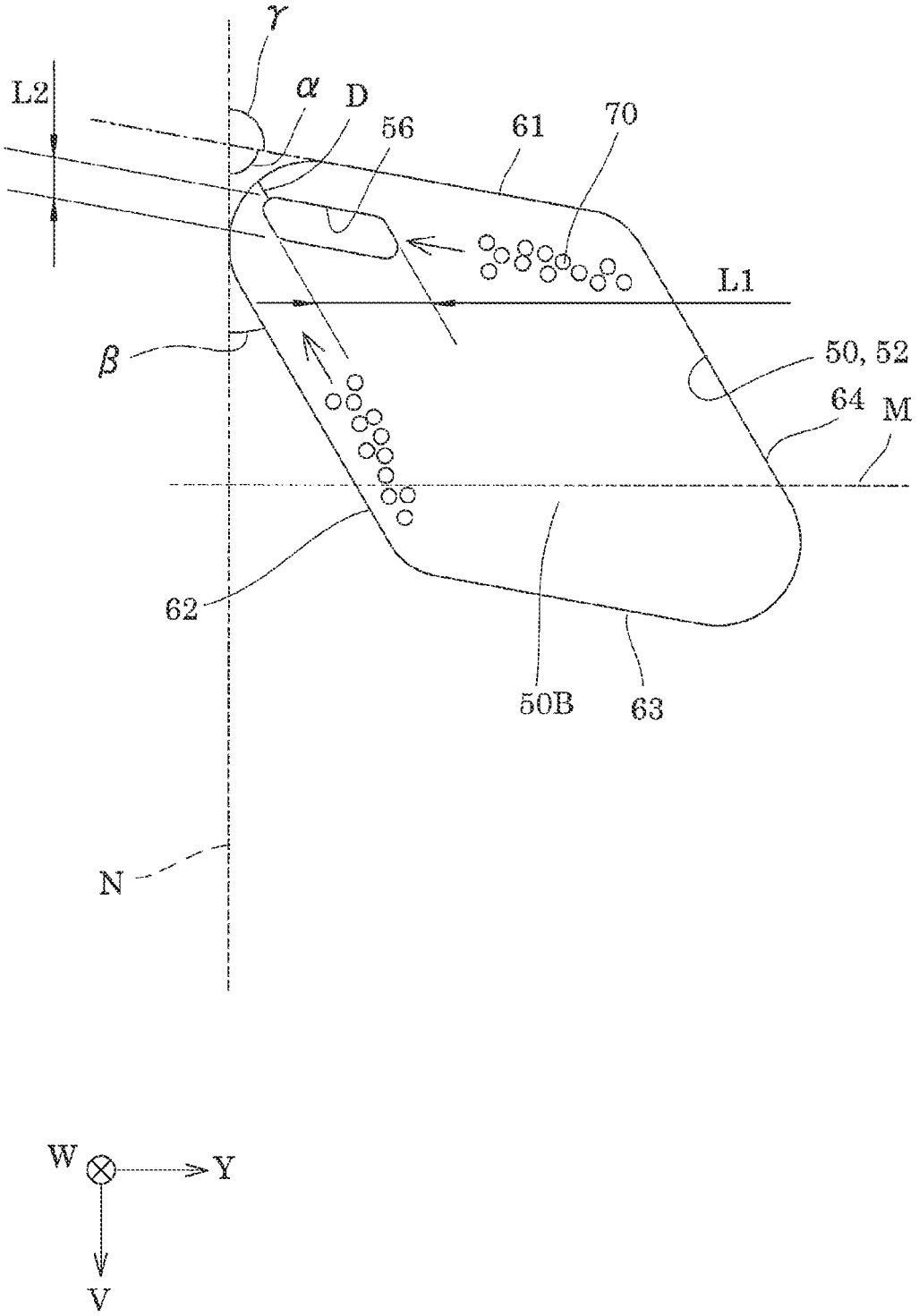
FIG. 7 is a plan view of a downstream chamber viewed in the direction perpendicular to the filter.

The filter member 20 of the recording head 100 according to the present embodiment will be described with reference to FIGS. 4 to 7. FIG. 4 is a plan view of the filter member viewed in the +Z direction, which is a direction perpendicular to the filter, FIG. 5 is a plan view of the interior of the filter member viewed in the +Z direction, which is the direction perpendicular to the filter, FIG. 6 is a sectional view along line VI-VI in FIG. 4, and FIG. 7 is a plan view of a downstream chamber viewed in the +W direction, which is the direction perpendicular to the filter.

Similarly to FIGS. 2 and 3, FIGS. 4 and 5 illustrate the filter member 20 of the recording head 100 arranged such that the ink ejection direction is the +Z direction. Similarly to FIG. 1, FIG. 6 illustrates the filter member 20 of the recording head 100 arranged such that the ink ejection direction is the +W direction. FIG. 7 illustrates a downstream chamber 50B of the recording head 100, which is viewed in the +W direction, arranged such that the ink ejection direction is the +W direction.

The filter member 20 includes a first filter member 21 and a second filter member 22, which are layered, and has the filter chamber 50 that accommodates the filter 57. Specifically, the filter member 20 includes the first filter member 21 provided on the holding section 6 side (−Z-direction side illustrated in FIGS. 4 and 5) and the second filter member 22 provided on the holder 23 side (+Z-direction side illustrated in FIGS. 4 and 5) of the first filter member 21, and the first filter member 21 and the second filter member 22 are layered. The first filter member 21 and the second filter member 22 may be formed of, for example, a resin material but are not limited to being formed of a resin material.

Figure 5:
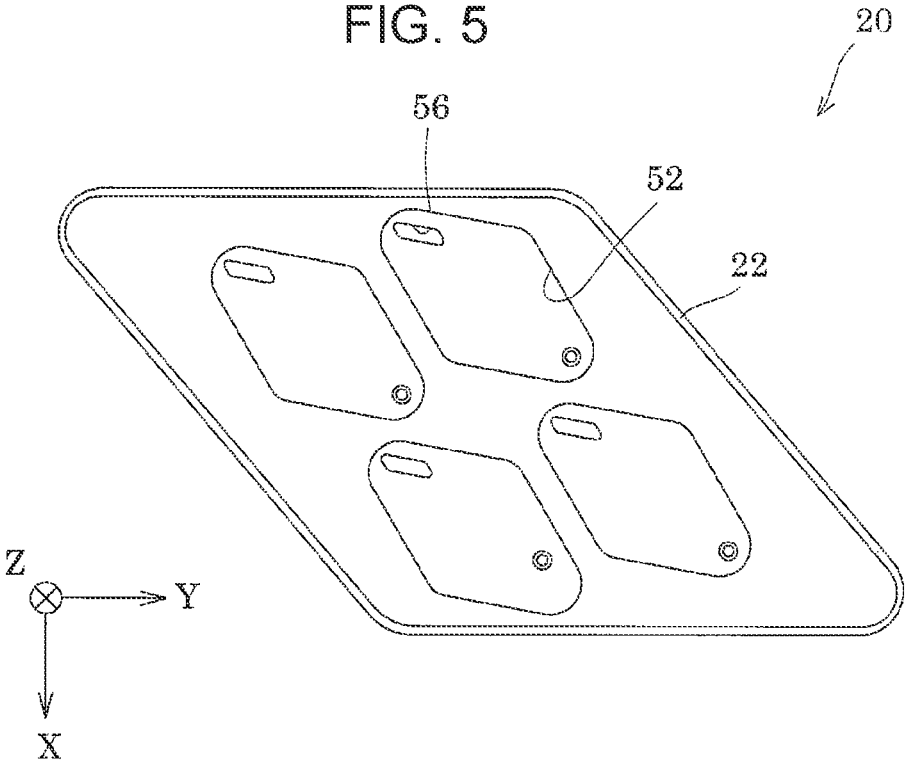
FIG. 5 is a plan view of an interior of the filter member viewed in the direction perpendicular to the filter.

A first concave section 51 is formed on a surface of the first filter member 21, which is on the second filter member 22 side (+Z-direction side illustrated in FIGS. 4 and 5). A supply section 55 that protrudes from a surface of the first filter member 21 is formed on the holding section 6 side (−Z-direction side illustrated in FIGS. 4 and 5) of the first filter member 21. An inlet 54 serving as a through hole is formed in the Z direction illustrated in FIGS. 4 and 5 to pass through the supply section 55. The supply section 55 is coupled to an exit of a channel (not illustrated) provided in the holding section 6. The inlet 54 is a channel for guiding ink supplied from the channel to the filter chamber 50.

A second concave section 52 is formed on a surface of the second filter member 22, which is on the first filter member 21 side (−Z-direction side illustrated in FIGS. 4 and 5). A nozzle introduction port 56 serving as an opening for supplying ink from the filter chamber 50 to the nozzles 31 of the head chip 30 via the holder 23 is formed on the holder 23 side (+Z-direction side illustrated in FIGS. 4 and 5) of the second filter member 22. In the present embodiment, the nozzle introduction port 56 is formed as a through hole provided in the bottom surface of the second concave section 52. Note that the nozzle introduction port 56 is an example of an outlet through which the ink flows out of the filter chamber 50. A channel (not illustrated) communicating with the nozzle introduction port 56 is formed in the second filter member 22, and the ink discharged from the nozzle introduction port 56 is supplied, via the channel, to the holder 23 from an opening (not illustrated) which is provided in the holder 23 and through which the ink is guided. The flow of the ink supplied to the holder 23 is divided in a channel (not illustrated) formed in the holder 23 to branch into the flows corresponding to the number of head chips 30 (six head chips 30 in the present embodiment), and the ink supplied to the holder 23 is supplied to the respective head chips 30.

The filter chamber 50 includes the first concave section 51 and the second concave section 52 formed by layering the first filter member 21 and the second filter member 22. The filter chamber 50 includes the filter 57 so as to cover an opening of the second concave section 52. Hereinafter, a space in the filter chamber 50 upstream of the filter 57 is referred to as an upstream chamber 50A, and a space in the filter chamber 50 downstream of the filter 57 is referred to as the downstream chamber 50B. A portion upstream of the filter 57 is a side further from the nozzles 31 for ejecting the ink in the recording head 100 than a portion downstream of the filter 57, which is a side relatively closer to the nozzles 31.

In the present embodiment, the filter 57 captures a foreign substance and air bubbles contained in the ink and is fixed to the second filter member 22 via heat welding, adhesive, or the like. Examples of the filter 57 include linear metal strands in a twilled weave form, a flat plate member made of SUS and having numerous holes, and nonwoven fabric.

In the present embodiment, four first concave sections 51 are formed in the first filter member 21, and four second concave sections 52 are formed in the second filter member 22. The filter member 20 is provided with four filter chambers 50 each including the first concave section 51 and the second concave section 52. Each of the filter chambers 50 includes a single supply section 55 and a single nozzle introduction port 56.

The ink is supplied from the four liquid containers 12 to the filter chambers 50 of the filter member 20 formed as described above via supply channels 13, the channel in the holding section 6, and supply sections 55. In the filter chamber 50, the ink supplied to the first concave section 51 side passes through the filter 57 and flows to the second concave section 52 side, and a foreign substance and air bubbles are captured by the filter 57. The ink that has passed through the filter 57 is discharged from the filter chamber 50 to the nozzle introduction port 56. The ink discharged from the nozzle introduction port 56 is supplied to each of the head chips 30 via the holder 23 as described above and is ejected from the nozzles 31.

The nozzle surface 30*a* on which the nozzles 31 are formed is arranged to be parallel to the filter 57.

As illustrated in FIGS. 1 and 6, the recording head 100 ejects the ink while the recording head 100 is inclined by the holding section 6. In such a state in which the recording head 100 is inclined, the nozzle introduction port 56 is located, with respect to the inlet 54, on the side opposite to the +Z direction side, the +Z direction being the direction of gravity. That is, the nozzle introduction port 56 is located above the inlet 54 in the Z direction. Moreover, the Y direction, which is the longitudinal direction of the line head 2 illustrated in FIGS. 1 and 2, is parallel to an intersecting line M illustrated in FIG. 7. Further, the V direction in which the medium S is transported is orthogonal to the intersecting line M.

Here, the configuration of the filter chamber 50 will be described in detail with reference to FIG. 7.

The filter chamber 50 includes a first side 61 and a second side 62 that extend toward the nozzle introduction port 56, which is the outlet, in plan view in the +W direction, which is the direction perpendicular to the filter 57. The filter chamber 50 further includes a third side 63 and a fourth side 64 parallel to the first side 61 and the second side 62, respectively, in plan view in the direction perpendicular to the filter 57. The filter chamber 50 has a substantially rhombic shape that includes the first side 61, the second side 62, the third side 63, and the fourth side 64 in plan view in the direction perpendicular to the filter 57.

A portion in which the first side 61, the second side 62, the third side 63, or the fourth side 64 intersects an adjacent side is referred to as an intersection. Each intersection may be a portion in which straight-line sides intersect each other or which has a round shape. The round shape is an arc shape or a polygonal shape close to a circular shape. The first side 61 and the second side 62 are preferably arranged such that their intersection is at the uppermost position in the filter chamber 50 when a single nozzle introduction port 56 is provided in the filter chamber 50. In FIG. 7, of the four intersections, the intersection of the first side 61 and the second side 62 is at the uppermost position in the direction of gravity.

The first side 61 and the second side 62 extending toward the nozzle introduction port 56 means that the nozzle introduction port 56 is arranged near the intersection of the first side 61 and the second side 62. Arranging the nozzle introduction port 56 near the intersection means that a minimum distance D between the intersection and an edge of the nozzle introduction port 56 is less than a dimension L1 of a long side of the nozzle introduction port 56, which is a maximum dimension of the nozzle introduction port 56. In the present embodiment, the minimum distance D between the intersection and the edge of the nozzle introduction port 56 is less than a dimension L2 of a short side of the nozzle introduction port 56, which is a minimum dimension of the nozzle introduction port 56.

Note that, in the present embodiment, the upstream chamber 50A and the downstream chamber 50B that form the filter chamber 50 have substantially the same shape. That is, the upstream chamber 50A and the downstream chamber 50B each have the first side 61 to the fourth side 64. Specifically, in plan view in the direction perpendicular to the filter 57, each of the first side 61 to the fourth side 64 of the upstream chamber 50A is an inner edge of a side wall that protrudes from the bottom surface of the first concave section 51, on which the inlet 54 is formed, to the second filter member 22 or is an outer edge of the bottom surface of the first concave section 51, on which the inlet 54 is formed. Similarly, in plan view in the direction perpendicular to the filter 57, each of the first side 61 to the fourth side 64 of the downstream chamber 50B is an inner edge of a side wall that protrudes from the bottom surface of the second concave section 52, on which the nozzle introduction port 56 is formed, to the first filter member 21 or is an outer edge of the bottom surface of the second concave section 52, on which the nozzle introduction port 56 is formed. However, the upstream chamber 50A and the downstream chamber 50B do not necessarily have the same shape. For example, the downstream chamber 50B having the nozzle introduction port 56 serving as the ink outlet may have the first side 61 to the fourth side 64 as described above, and the upstream chamber 50A may have any shape.

The first side 61 and a virtual straight line N that is orthogonal to the intersecting line M where the filter 57 and the horizontal plane intersect each other and that extends in the V direction, which is a direction along the filter 57, form a first angle $\alpha$ in plan view in the direction perpendicular to the filter 57. The horizontal plane is a plane orthogonal to the +Z direction, which is the vertical direction, and is the XY plane formed by the X-axis and the Y-axis. The direction along the filter 57 is a direction parallel to the VY plane formed by the V-axis and the Y-axis. Moreover, the second side 62 and the virtual straight line N form a second angle $\beta$ smaller than the first angle $\alpha$ in plan view in the direction perpendicular to the filter 57. Note that the first angle $\alpha$ and the second angle $\beta$ are greater than 0 degrees and smaller than 90 degrees.

The first angle $\alpha$ formed by the first side 61 and the virtual straight line N is the smaller angle of angles formed by the first side 61 and the virtual straight line N. In the example illustrated in FIG. 7, $\alpha$ and $\gamma$ are angles formed by an extended line of the first side 61 and the virtual straight line N, and the smaller angle $\alpha$ is the first angle. The same is applicable to the second angle $\beta$, and the second angle $\beta$ is the smaller angle of angles formed by the second side 62 and the virtual straight line N.

The nozzle introduction port 56 is elongated along the first side 61 in plan view in the direction perpendicular to the filter 57. In other words, of the sides of the nozzle introduction port 56, a side extending along the first side 61 is longer than a side extending along the second side 62. In the present embodiment, the nozzle introduction port 56 is formed such that the dimension L1 thereof in the direction along the first side 61 is longer than the dimension L2 thereof in the direction along the second side 62 in plan view in the direction perpendicular to the filter 57.

Note that the nozzle introduction port 56 of the present embodiment has a substantially parallelogram shape in plan view illustrated in FIG. 7 but is not limited to having such a shape. For example, the nozzle introduction port 56 may have a substantially elliptical shape, a substantially rhombic shape, a substantially rectangular shape, a substantially polygonal shape, or the like. When the nozzle introduction port 56 has a substantially elliptical shape, a substantially polygonal shape, or the like, a shape in which the nozzle introduction port 56 is elongated along the first side 61 in plan view in the direction perpendicular to the filter 57 is the following shape. Specifically, the nozzle introduction port 56 is formed such that a maximum value of an opening width of the nozzle introduction port 56 in the direction along the first side 61 is greater than a maximum value of an opening width of the nozzle introduction port 56 in the direction along the second side 62.

Such a filter chamber 50 is filled with ink from the liquid container 12, a foreign substance and air bubbles are captured by the filter 57, and the ink that has passed through the filter 57 is discharged from the nozzle introduction port 56 to the head chip 30 via the holder 23. Suction cleaning is performed to discharge, from the filter chamber 50, the air bubbles captured by the filter 57. Suction cleaning is an operation of sealing the nozzle surface 30*a* of the recording head 100 in a closed space by using a cap or the like and performing suction in the closed space by using a suction apparatus such as a suction pump to forcibly discharge air bubbles from the nozzles 31 together with the ink. Suction cleaning enables air bubbles 70 captured in the upstream chamber 50A to flow into the downstream chamber 50B through the filter 57.

The air bubbles 70 flow into the downstream chamber 50B upon suction cleaning and may flow into the downstream chamber 50B in other instances. For example, when air bubbles are captured in the filter chamber 50 during a printing operation of ejecting ink from the nozzles 31 onto the medium S to form an image, the air bubbles may gather and grow larger. When the air bubbles grow larger in the upstream chamber 50A, the air bubbles come into contact with the filter 57, and some air bubbles may pass through the filter 57 and flow into the downstream chamber 50B. The air bubbles flowing into the downstream chamber 50B upon suction cleaning or a printing operation as described above are discharged from the filter chamber 50 in the following manner.

As described above, the second angle $\beta$ is smaller than the first angle $\alpha$. In other words, the first side 61 is gently inclined relative to the WY plane, which is the horizontal plane, and the second side 62 is sharply inclined relative to the WY plane. Thus, in the downstream chamber 50B, due to buoyancy or the flow of the ink, the air bubbles 70 flowing along the first side 61 move to the nozzle introduction port 56 relatively slowly, and the air bubbles 70 flowing along the second side 62 move to the nozzle introduction port 56 relatively quickly.

On the other hand, the nozzle introduction port 56 is elongated along the first side 61. Thus, a distance from the air bubbles 70 flowing along the first side 61 to the nozzle introduction port 56 is shorter than a distance from the air bubbles 70 flowing along the second side 62 to the nozzle introduction port 56.

Thus, although the air bubbles 70 flowing along the first side 61 move slowly to the nozzle introduction port 56, the distance to the nozzle introduction port 56 is short, and the air bubbles 70 thus flow promptly into the nozzle introduction port 56. Although the distance from the air bubbles 70 flowing along the second side 62 to the nozzle introduction port 56 is long, the air bubbles 70 move quickly to the nozzle introduction port 56 and thus flow promptly into the nozzle introduction port 56. In this manner, even when the first angle α formed by the first side 61 and the virtual straight line N and the second angle β formed by the second side 62 and the virtual straight line N differ from each other, since the nozzle introduction port 56 is elongated along the first side 61, it is possible to improve the performance of discharging the air bubbles 70 from the filter chamber 50 to the nozzle introduction port 56.

Here, in an instance in which a downstream chamber of a filter chamber has a linearly symmetrical shape in plan view of a filter as in the related art, when plural filter chambers are provided side by side, more spaces in which the filter chambers are arranged need to be ensured depending on a shape or configuration of a recording head, thus increasing the recording head in size. A reduction in area of the filter 57 is required to avoid such increase in size, which may constrain the performance of the recording head 100.

However, the first angle α formed by the first side 61 and the virtual straight line N and the second angle β formed by the second side 62 and the virtual straight line N differ from each other in the downstream chamber 50B of the present embodiment. That is, the downstream chamber 50B is asymmetrical with respect to the virtual straight line N, and a space in which the plural filter chambers 50 are arranged is thus reduced and it is possible to suppress a size increase in the recording head 100 and to increase the area of the filter 57. Providing the asymmetric filter chamber 50 enables a size increase to be suppressed in the recording head 100, enables an area of the filter 57 to increase, and improves the performance of discharging air bubbles.

As described above, the recording head 100 according to the present embodiment includes the nozzles 31 that eject ink, the filter chamber 50 that accommodates the filter 57, and the nozzle introduction port 56 serving as an outlet through which the ink flows out of the filter chamber 50. The filter chamber 50 includes the first side 61 and the second side 62 (refer to FIG. 7) that extend toward the nozzle introduction port 56 in plan view in the +Z direction, which is the direction perpendicular to the filter 57, as illustrated in FIG. 4, and the nozzle introduction port 56 is elongated along the first side 61 in plan view in the direction perpendicular to the filter 57.

In a state in which such a recording head 100 is held to be inclined so as to eject the ink in the +W direction inclined relative to the +Z direction, which is the vertical direction, as illustrated in FIGS. 1 and 6, even when the first angle α formed by the first side 61 and the virtual straight line N and the second angle β formed by the second side 62 and the virtual straight line N differ from each other as illustrated in FIG. 7, the nozzle introduction port 56 is elongated along the first side 61, thus making it possible to improve the performance of discharging the air bubbles 70 from the filter chamber 50 to the nozzle introduction port 56.

Moreover, in the recording head 100 of the present embodiment, preferably, the nozzle introduction port 56 is an opening through which the ink is supplied from the filter chamber 50 to the nozzles 31. This enables air bubbles to be readily discharged from the filter chamber 50 to the nozzles 31.

Moreover, the ink jet recording apparatus 1 of the present embodiment includes the recording head 100 and the holding section 6 that holds the recording head 100 such that the filter 57 is inclined relative to the XY plane, which is the horizontal plane. According to such an ink jet recording apparatus 1, it is possible to improve the performance of discharging the air bubbles 70 in the filter chamber 50 of the recording head 100 that is held in a state of being inclined so as to eject the ink in the +W direction inclined relative to the +Z direction, which is the vertical direction, as illustrated in FIGS. 1 and 6.

Moreover, in the ink jet recording apparatus 1 of the present embodiment, preferably, the recording head 100 includes the nozzle surface 30*a* on which the nozzles 31 are formed, and the nozzle surface 30*a* is parallel to the filter 57. Accordingly, even when the recording head 100 is used in a state of being inclined so as to eject the ink in the +W direction, it is possible to improve the performance of discharging air bubbles in the filter chamber 50. Note that the nozzle surface 30*a* is not necessarily parallel to the filter 57.

Moreover, preferably, the recording head 100 of the present embodiment includes the inlet 54 through which the ink flows into the filter chamber 50, and the nozzle introduction port 56 is arranged, with respect to the inlet 54, in the −Z direction opposite to the +Z direction, which is the direction of gravity.

Moreover, in the ink jet recording apparatus 1 of the present embodiment, preferably, the first side 61 and the virtual straight line N that is orthogonal to the intersecting line M where the filter 57 and the XY plane, which is the horizontal plane, intersect each other and that extends in the V direction along the filter 57 form the first angle α in plan view in the direction perpendicular to the filter 57, and the second side 62 and the virtual straight line N form the second angle β, which is smaller than the first angle α, in plan view in the direction perpendicular to the filter 57, and the nozzle introduction port 56 is elongated along the first side 61.

Even when the first angle α, which is an inclination angle formed by the first side 61 and the virtual straight line N, and the second angle β, which is an inclination angle formed by the second side 62 and the virtual straight line N, differ from each other, since the nozzle introduction port 56 is elongated along the first side 61, it is possible to efficiently discharge, from the nozzle introduction port 56, air bubbles moving along the first side 61.

Moreover, in the ink jet recording apparatus 1 of the present embodiment, preferably, the first angle α and the second angle β are greater than 0 degrees and smaller than 90 degrees.

Moreover, in the ink jet recording apparatus 1 of the present embodiment, preferably, the filter chamber 50 in plan view in the direction perpendicular to the filter 57 has a substantially rectangular shape having the first side 61, the second side 62, the third side 63 parallel to the first side 61, and the fourth side 64 parallel to the second side 62. Accordingly, even when the plural filter chambers 50 are provided, it is possible to reduce the size of the filter member 20 while suppressing increase in the size of the filter 57 compared with an instance in which a filter that is linearly symmetrical with respect to the virtual straight line N is provided.

Moreover, in the ink jet recording apparatus 1 of the present embodiment, preferably, the downstream chamber 50B located downstream of the filter 57 of the filter chamber 50 in plan view in the direction perpendicular to the filter 57 has a substantially parallelogram shape or a substantially rhombic shape. Accordingly, even when the plural filter chambers 50 are provided, it is possible to reduce the size of the filter member 20 while suppressing increase in the size of the filter 57 compared with an instance in which a filter that is linearly symmetrical with respect to the virtual straight line N is provided.

Moreover, preferably, the ink jet recording apparatus 1 of the present embodiment includes the line head 2 including the recording head 100, in which the longitudinal direction of the line head 2 extends in the Y direction parallel to the intersecting line M. Although the line head 2 has the recording head 100 inclined about the longitudinal direction (Y direction in the example of FIG. 1) as a rotational axis, even when such a line head 2 is used, it is possible to improve the performance of discharging air bubbles in the filter chamber 50.

Moreover, preferably, the ink jet recording apparatus 1 of the present embodiment includes the transport section 4 that transports the medium S in the transport direction, which is the +V direction or the −V direction orthogonal to the intersecting line M. Accordingly, even when the transport direction in which the medium S is transported is inclined, it is possible to improve the performance of discharging air bubbles in the filter chamber 50.

Embodiment 2

Figure 8:
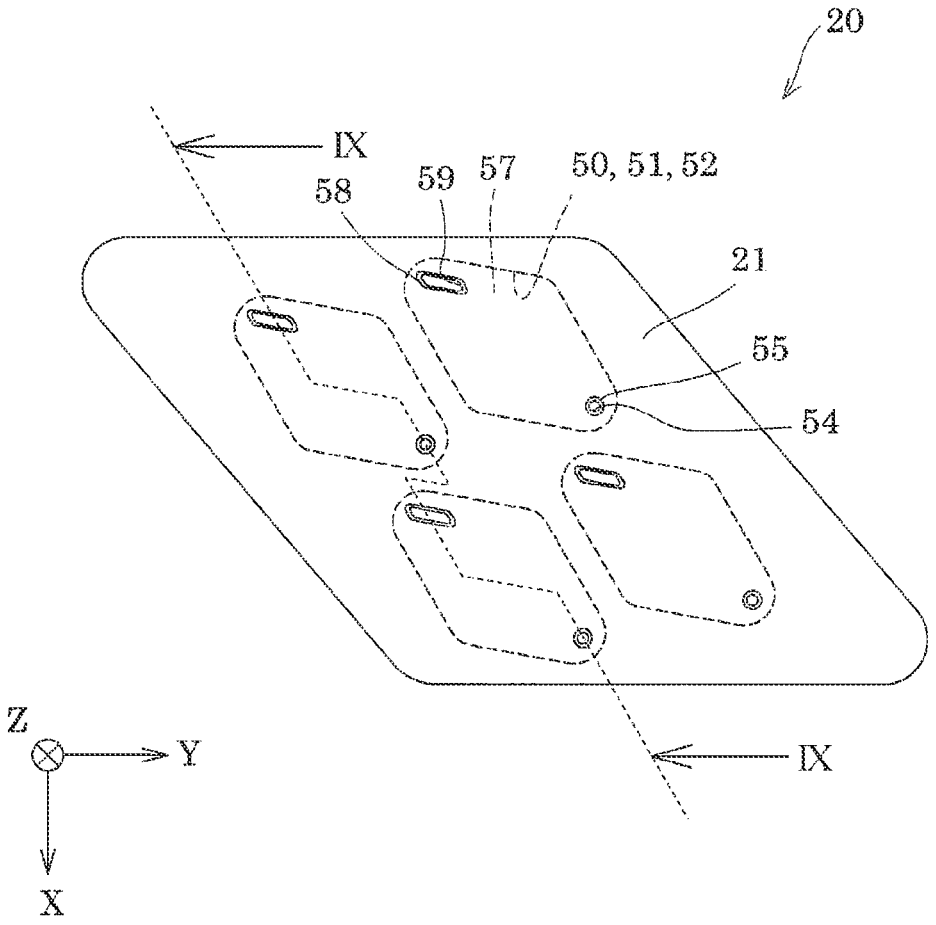
FIG. 8 is a plan view of a filter member viewed in a direction perpendicular to a filter.
Figure 9:
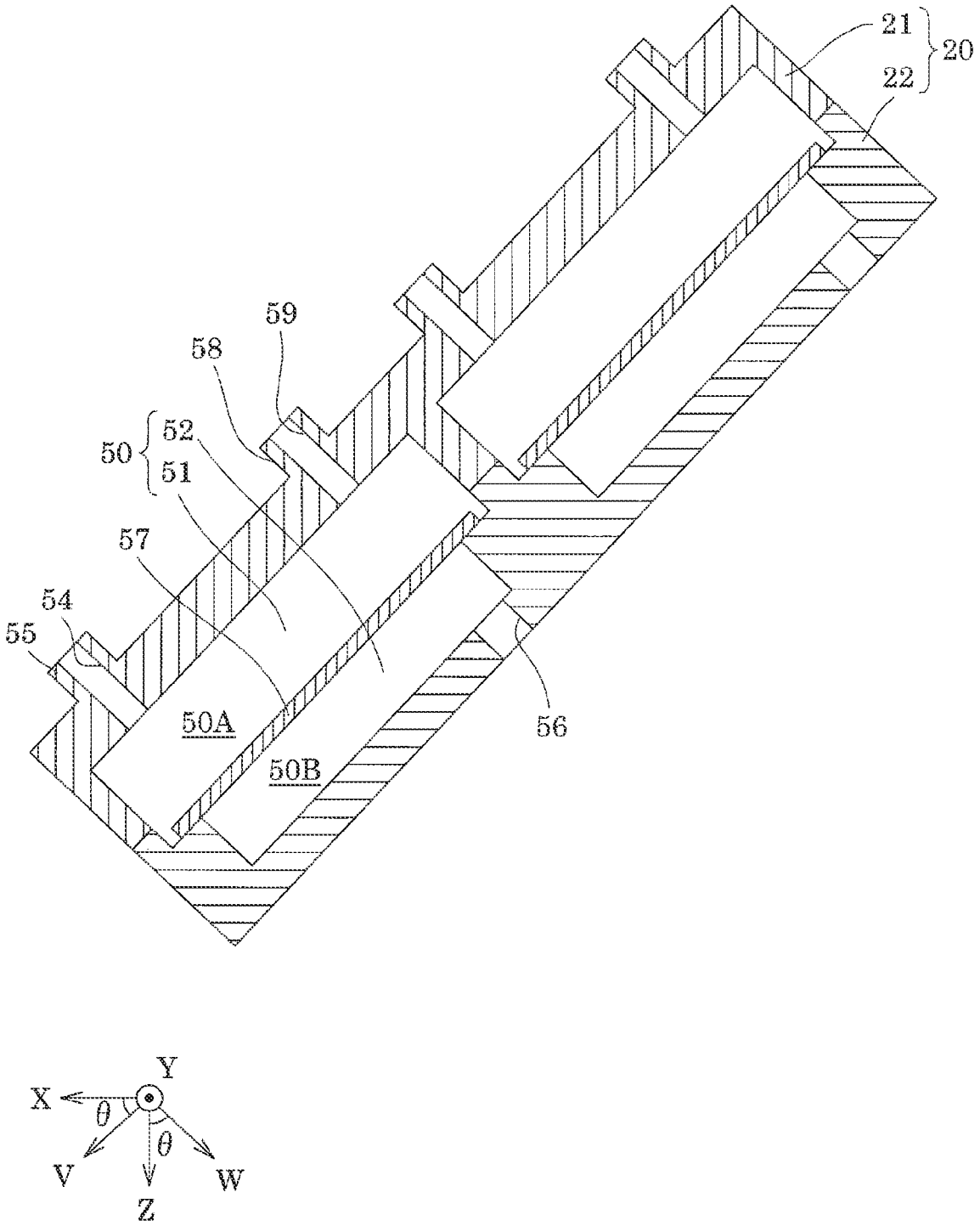
FIG. 9 is a sectional view along line IX-IX in FIG. 8.
Figure 10:
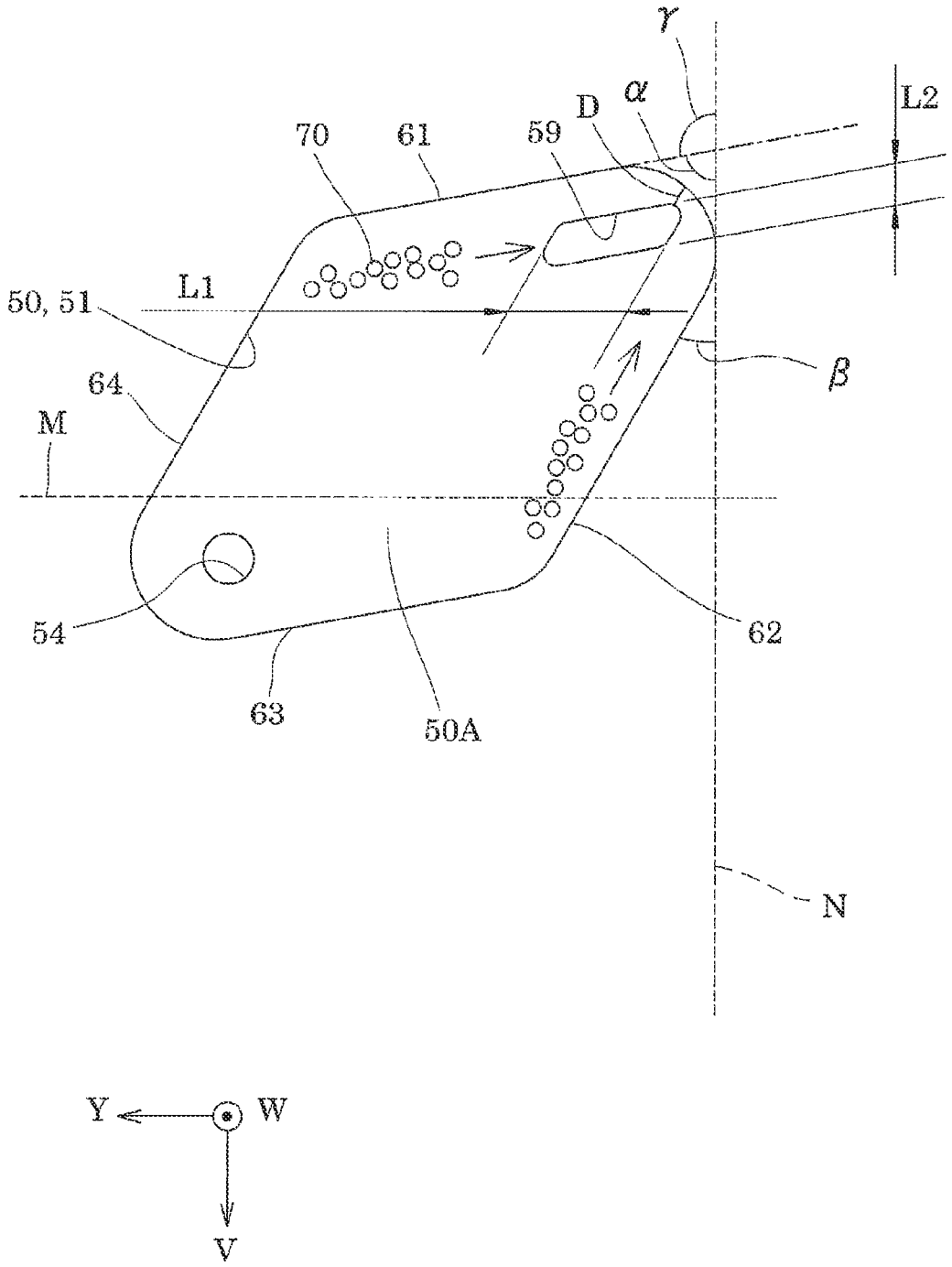
FIG. 10 is a plan view of an upstream chamber viewed in the direction perpendicular to the filter.

FIG. 8 is a plan view of a filter member viewed in the +Z direction, which is a direction perpendicular to a filter, according to Embodiment 2 of the disclosure, FIG. 9 is a sectional view along line IX-IX in FIG. 8, and FIG. 10 is a plan view of an upstream chamber viewed in a direction opposite to the +W direction, which is the direction perpendicular to the filter. Note that members similar to those of Embodiment 1 will be given the same reference numerals, and redundant description thereof will be omitted.

FIG. 8 illustrates the filter member 20 of the recording head 100 arranged such that the ink ejection direction is the +Z direction. FIG. 9 illustrates the filter member 20 of the recording head 100 arranged such that the ink ejection direction is the +W direction. FIG. 10 illustrates the upstream chamber 50A of the recording head 100, which is viewed in the direction (−W direction) opposite to the +W direction, arranged such that the ink ejection direction is the +W direction.

Although not particularly illustrated, the ink jet recording apparatus of the present embodiment is an example of a liquid ejecting apparatus of a circulation type in which ink supplied to the recording head 100 returns from the recording head 100 to the liquid container 12. The holding section 6 of the present embodiment includes a first channel (not illustrated) for supplying the ink from the liquid container 12 to the recording head 100 and also includes a second channel (not illustrated) through which the ink returning from the recording head 100 flows. The holding section 6 is coupled to a discharge channel (not illustrated) for coupling the second channel and the liquid container 12. That is, the ink is supplied from the liquid container 12 to the supply channel 13, the first channel, and the recording head 100, and the ink that has not been ejected from the recording head 100 returns to the recording head 100, the second channel, the discharge channel, and the liquid container 12.

In the recording head 100 of the present embodiment, a discharging section 58 that protrudes from a surface of the first filter member 21 is formed on the holding section 6 side (−Z-direction side in FIG. 8) of the first filter member 21. A discharge port 59 serving as a through hole extending in the Z direction illustrated in FIG. 8 is formed in the discharging section 58. The discharging section 58 is coupled to the aforementioned second channel provided in the holding section 6. The discharge port 59 serves as a channel for returning the ink to the second channel of the holding section 6.

In the filter member 20 configured as described above, the ink is supplied from the holding section 6 to the upstream chamber 50A via the inlet 54. The ink that has not passed through the filter 57 in the upstream chamber 50A returns to the second channel of the holding section 6 via the discharge port 59.

In the present embodiment, the nozzle introduction port 56 and the discharge port 59 serve as the outlet through which the ink flows out of the filter chamber 50. As illustrated in FIG. 10, the discharge port 59 is elongated along the first side 61 in plan view in the direction perpendicular to the filter 57. In other words, of the sides of the discharge port 59, a side extending along the first side 61 is longer than a side extending along the second side 62. In the present embodiment, the discharge port 59 has an elongated shape in which a dimension L1 of the discharge port 59 in the direction along the first side 61 in plan view in the direction perpendicular to the filter 57 is longer than a dimension L2 thereof in the direction along the second side 62. While the recording head 100 is inclined, the discharge port 59 is arranged, with respect to the inlet 54, on the side opposite to the +Z direction, which is the direction of gravity. That is, the discharge port 59 is arranged above the inlet 54 in the Z direction.

Note that the discharge port 59 of the present embodiment has a substantially parallelogram shape in plan view illustrated in FIG. 10 but is not limited to having such a shape. Similarly to the shape of the nozzle introduction port 56, the discharge port 59 may have a substantially elliptical shape, a substantially rhombic shape, a substantially rectangular shape, a substantially polygonal shape, or the like.

In the recording head 100 configured as described above, the second angle $\beta$ formed by the second side 62 of the upstream chamber 50A and the virtual straight line N is smaller than the first angle $\alpha$ formed by the first side 61 of the upstream chamber 50A and the virtual straight line N. In other words, the first side 61 is inclined gently relative to the WY plane, which is the horizontal plane, and the second side 62 is inclined sharply relative to the WY plane. Thus, in the upstream chamber 50A, due to buoyancy or the flow of the ink, the air bubbles 70 flowing along the first side 61 move to the discharge port 59 relatively slowly, and the air bubbles 70 flowing along the second side 62 move to the discharge port 59 relatively quickly.

On the other hand, the discharge port 59 is elongated along the first side 61. Thus, a distance from the air bubbles 70 flowing along the first side 61 to the discharge port 59 is shorter than a distance from the air bubbles 70 flowing along the second side 62 to the discharge port 59.

Thus, although the air bubbles 70 flowing along the first side 61 move slowly to the discharge port 59, the distance to the discharge port 59 is short, and the air bubbles 70 thus flow promptly into the discharge port 59. Although the distance from the air bubbles 70 flowing along the second side 62 to the discharge port 59 is long, the air bubbles 70 move quickly to the discharge port 59 and thus flow promptly into the discharge port 59. In this manner, even when the first angle α formed by the first side 61 and the virtual straight line N and the second angle β formed by the second side 62 and the virtual straight line N differ from each other, since the discharge port 59 is elongated along the first side 61, it is also possible to improve the performance of discharging the air bubbles 70 in the upstream chamber 50A of the filter chamber 50 to the discharge port 59.

Note that, similarly to Embodiment 1, in the downstream chamber 50B, the nozzle introduction port 56 is elongated along the first side 61 of the downstream chamber 50B but is not limited to such an aspect. For example, the nozzle introduction port 56 is not necessarily elongated along the first side 56.

Embodiment 3

Figure 11:
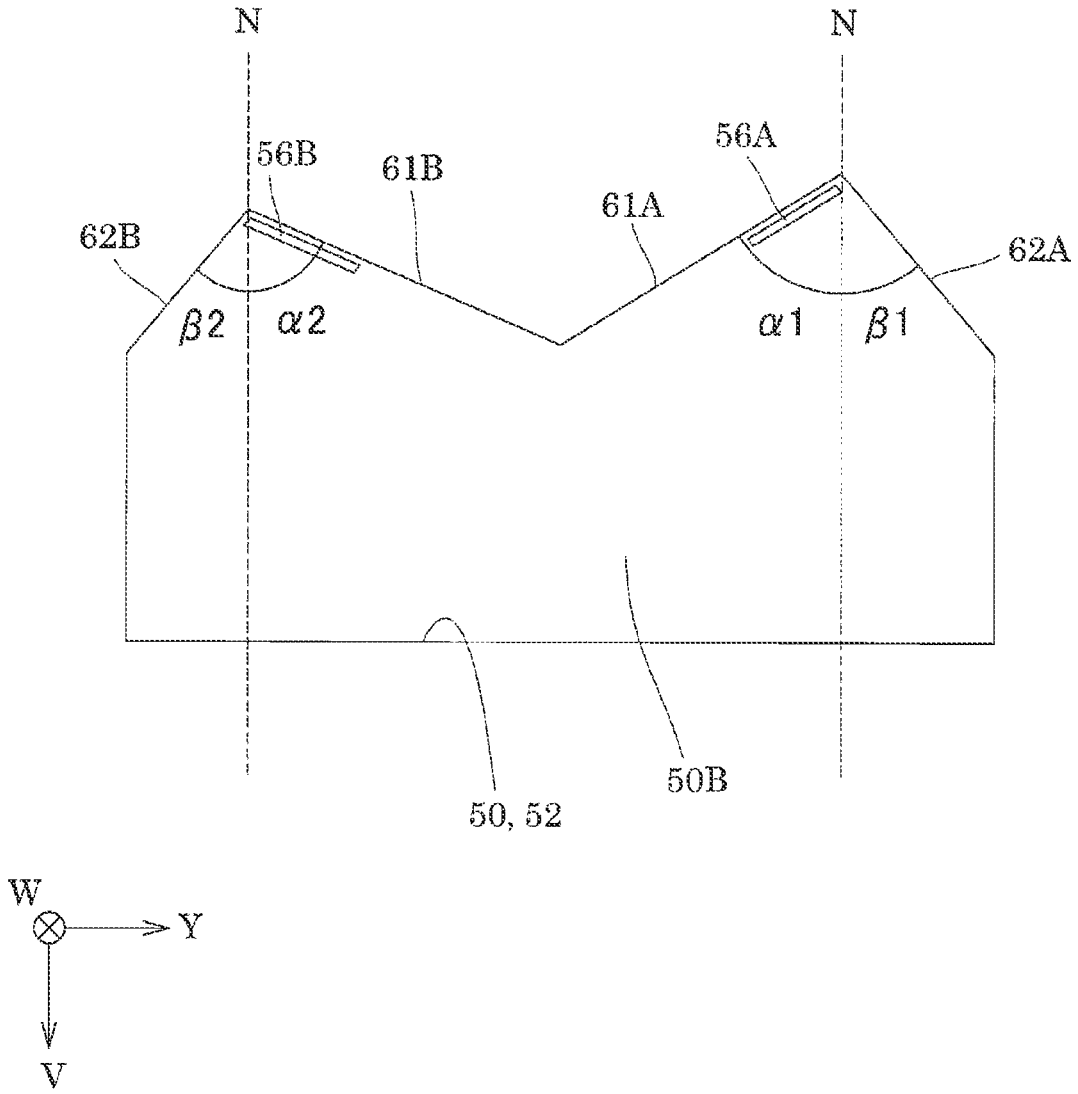
FIG. 11 is a plan view of a downstream chamber viewed in a direction perpendicular to a filter.

FIG. 11 is a plan view of a downstream chamber of a filter chamber viewed in the +W direction, which is a direction perpendicular to a filter, according to Embodiment 3 of the disclosure. FIG. 11 illustrates the downstream chamber of the recording head 100 arranged such that the ink ejection direction is the +W direction. Note that members similar to those of Embodiment 1 will be given the same reference numerals, and redundant description thereof will be omitted.

As illustrated in FIG. 11, the filter chamber 50 includes a nozzle introduction port 56A and a nozzle introduction port 56B serving as plural outlets. In this manner, the filter chamber 50 may include the plural outlets.

The downstream chamber 50B has a substantially polygonal shape having a first side 61A, a second side 62A, a first side 61B, and a second side 62B in plan view in the direction perpendicular to the filter.

The first side 61A and the virtual straight line N form a first angle α1 in plan view in the direction perpendicular to the filter. The second side 62A and the virtual straight line N form a second angle β1, which is smaller than the first angle α1, in plan view in the direction perpendicular to the filter. The first side 61B and the virtual straight line N form a first angle α2 in plan view in the direction perpendicular to the filter. The second side 62B and the virtual straight line N form a second angle β2, which is smaller than the first angle α2, in plan view in the direction perpendicular to the filter.

The nozzle introduction port 56A is elongated along the first side 61A in plan view in the direction perpendicular to the filter. In other words, of the sides of the nozzle introduction port 56A, a side extending along the first side 61A is longer than a side extending along the second side 62A. The nozzle introduction port 56B is elongated along the first side 61B in plan view in the direction perpendicular to the filter. In other words, of the sides of the nozzle introduction port 56B, a side extending along the first side 61B is longer than a side extending along the second side 62B.

The positions of the nozzle introduction port 56A and the nozzle introduction port 56B in the V direction are not particularly limited and may be shifted in the V direction as illustrated in FIG. 11.

In the recording head 100 configured as described above, although air bubbles (not illustrated) flowing along the first side 61A move slowly to the nozzle introduction port 56A, a distance to the nozzle introduction port 56A is short, and the air bubbles thus flow promptly into the nozzle introduction port 56A. Although a distance from air bubbles flowing along the second side 62A to the nozzle introduction port 56A is long, the air bubbles move quickly to the nozzle introduction port 56A and thus flow promptly into the nozzle introduction port 56A. In this manner, even when the first angle α1 formed by the first side 61A and the virtual straight line N and the second angle β1 formed by the second side 62A and the virtual straight line N differ from each other, since the nozzle introduction port 56A is elongated along the first side 61A, it is possible to improve the performance of discharging the air bubbles from the downstream chamber 50B of the filter chamber 50 to the nozzle introduction port 56A. The same is applicable to the nozzle introduction port 56B.

Other Embodiments

Although embodiments of the disclosure have been described above, the basic configuration of the disclosure is not limited to the above.

For example, the nozzle introduction port 56 is elongated along the first side 61 in plan view in the direction perpendicular to the filter but is not limited thereto and may be elongated along the second side 62.

The nozzle introduction port 56 is cited as an example of the outlet, but the outlet is not limited thereto as long as the outlet enables ink to flow out of the filter chamber. For example, the outlet may enable ink discharged from the downstream chamber 50B of the filter chamber 50 to be discharged to outside of the recording head 100.

Although a channel for supplying ink to the filter chamber 50 is formed in the holding section 6 in the aforementioned embodiments, the channel is not necessarily formed in the holding section 6. That is, a channel member for supplying ink to the filter chamber 50 may be provided instead of the holding section 6, or the supply channel 13 and the inlet 54 of the filter member 20 may be directly coupled.

A substantially rhombic shape in the present specification includes, for example, both a shape in which an intersection in which the first side 61, the second side 62, the third side 63, or the fourth side 61 of the filter chamber 50 intersects an adjacent side has a round shape as illustrated in FIG. 7 and a shape which differs from the round shape as illustrated in FIG. 7 and in which a straight line of the first side 61, the second side 62, the third side 63, or the fourth side 64 intersects a straight line of an adjacent side. Moreover, even when the filter chamber 50 has a substantially quadrangle shape, a substantially parallelogram shape, a substantially rectangular shape, a substantially polygonal shape, or the like, the shape includes both a shape in which each of the intersections has a round shape or a shape in which each of the intersections does not have a round shape. Further, the same is applicable not only to the shape of the filter chamber 50 but also to the shape of the outlet such as the nozzle introduction port 56 or the discharge port 59.

Although a recording apparatus of a line head type in which the line head 2 including the recording head 100 is fixed to the holding section 6 and which performs printing simply by transporting the medium S has been exemplified as the ink jet recording apparatus 1 in the aforementioned embodiments, the disclosure is not limited thereto. The disclosure is applicable to a recording apparatus of a serial head type in which the recording head 100 is mounted on a carriage that moves in a direction intersecting the transport direction of the medium S and in which printing is performed while the recording head 100 reciprocates in the direction intersecting the transport direction. The carriage of such a recording apparatus of a serial head type corresponds to the holding section of the disclosure. That is, the carriage holds the recording head 100 in a state in which the recording head 100 is inclined such that the ink ejection direction is inclined relative to the +Z direction. The direction in which the carriage reciprocates is parallel to the intersecting line M. Such a recording apparatus of a serial head type is also able to improve the performance of discharging air bubbles in the filter chamber similarly to Embodiment 1.

The disclosure is directed to a wide variety of liquid ejecting heads and is applicable to, for example, a recording head such as various kinds of ink jet recording heads used in an image recording apparatus such as a printer, a color material ejecting head that is used to produce color filters for a liquid crystal display, etc., an electrode material ejecting head that is used for electrode formation in an organic EL display, an FED (field emission display), etc., and a biological organic material ejecting head that is used for production of biochips, etc. Needless to say, application of a liquid ejecting apparatus on which such a liquid ejecting head is mounted is not particularly limited.

What is claimed is:

1. A liquid ejecting apparatus comprising:

a liquid ejecting heading including a nozzle configured to eject a liquid, a filter chamber accommodating a filter, an inlet through which the liquid flows into the filter chamber, an outlet through which the liquid flows out of the filter chamber; and a holding section that holds the liquid ejecting head such that the filter is inclined relative to a horizontal plane, wherein the outlet is arranged in a direction opposite to a direction of gravity with respect to the inlet, an outer edge of the filter chamber includes a first side and a second side that extend toward the outlet in plan view in a direction perpendicular to the filter, a first angle is formed between the first side and a virtual straight line that is orthogonal to an intersecting line where the filter intersects the horizontal plane and that extends in a direction along the filter in plan view in the direction perpendicular to the filter, and a second angle, which is smaller than the first angle, is formed between the second side and the virtual straight line in plan view in the direction perpendicular to the filter, the first angle and the second angle are greater than 0 degrees and smaller than 90 degrees, and the outlet is elongated along the first side in plan view in the direction perpendicular to the filter.

2. The liquid ejecting apparatus according to claim 1, wherein the outlet is an opening through which the liquid is supplied from the filter chamber to the nozzle.

3. The liquid ejecting apparatus according to claim 1, wherein the liquid ejecting head includes a nozzle surface on which the nozzle is formed, and the nozzle surface is parallel to the filter.

4. The liquid ejecting apparatus according to claim 1, wherein the filter chamber in plan view in the direction perpendicular to the filter has a substantially rectangular shape having the first side, the second side, a third side parallel to the first side, and a fourth side parallel to the second side.

5. The liquid ejecting apparatus according to claim 4, wherein the filter chamber includes a downstream chamber located downstream of the filter, and the downstream chamber in plan view in the direction perpendicular to the filter has a substantially parallelogram shape or a substantially rhombic shape.

6. The liquid ejecting apparatus according to claim 1, further comprising a line head including the liquid ejecting head, wherein a longitudinal direction of the line head is parallel to the intersecting line.

7. The liquid ejecting apparatus according to claim 6, wherein the first side and the second side respectively intersect to the intersecting line.

8. The liquid ejecting apparatus according to claim 1, further comprising a transport section that transports a medium in a transport direction, wherein the transport direction is orthogonal to the intersecting line.

9. The liquid ejecting apparatus according to claim 8, wherein the first side and the second side respectively intersect to both of the intersecting line and the transport direction.

10. The liquid ejecting apparatus according to claim 1, wherein the outlet is arranged near an intersection of the first side and the second side.

11. The liquid ejecting apparatus according to claim 10, wherein a minimum distance between the intersection and an edge of the outlet is less than a dimension of a long side of the outlet, which is a maximum dimension of the outlet.

12. The liquid ejecting apparatus according to claim 10, wherein the minimum distance between the intersection and the edge of the outlet is less than a dimension of a short side of the outlet, which is a minimum dimension of the outlet.

13. The liquid ejecting apparatus according to claim 1, wherein a direction in which the holding section reciprocates is parallel to the intersecting line, the first side and the second side respectively intersect to the intersecting line.

* * * * *